United States Patent [19]

Kellener

[11] Patent Number: 5,050,662

[45] Date of Patent: Sep. 24, 1991

[54] DECORATIVE VENETIAN BLIND

[75] Inventor: Julius Kellener, 68 Bangor St., Staten Island, N.Y. 10314

[73] Assignee: Julius Kellener, Staten Island, N.Y.

[21] Appl. No.: 565,718

[22] Filed: Aug. 13, 1990

[51] Int. Cl.[5] ..... E06B 9/00

[52] U.S. Cl. ..... 160/168.1; 160/236; 160/900

[58] Field of Search ..... 160/236, 168.1, 900; 428/101

[56] References Cited

U.S. PATENT DOCUMENTS

| | | | |
|---|---|---|---|
| 2,074,482 | 3/1937 | Martens | 160/236 |
| 4,519,435 | 5/1985 | Stier | 160/236 X |
| 4,628,980 | 12/1986 | Le Houillier | 160/236 X |
| 4,773,958 | 9/1988 | Goodman | 160/236 X |
| 4,842,036 | 6/1989 | Goodman | 160/236 X |
| 4,911,220 | 3/1990 | Keller | 160/900 X |

FOREIGN PATENT DOCUMENTS

| | | | |
|---|---|---|---|
| 1256690 | 10/1989 | Japan | 160/236 |

*Primary Examiner*—Carl D. Friedman
*Assistant Examiner*—Korie H. Chan

[57] ABSTRACT

A louver system consisting a plurality of slats depending from a mounting to form a screen, the slats being collectively displacable and rotatable, individual slats being multi-layered over at least a part of their length, said multi-layered slats being coordinated with other multi-layered slats to permit the formation of designs in the face of the screen.

1 Claim, 1 Drawing Sheet

DECORATIVE VENETIAN BLIND

This invention relates to venetian blinds and more particularly to the placing of designs on a screen formed by slats making up the blind.

BACKGROUND OF THE INVENTION

Heretofore, it has been found commercially cumbersome to put designs such as graphics on the face of a screen formed by slats or louvers. In the past this has been attempted by painting, printing and the like, none of which has been commercially expedient for a multitude of reasons.

It is now proposed to accomplish this with slats which are multi-layered over at least a part of their length, said multi-layered slats being coordinated with other multi-layered slats to form designs in the face of the screen.

It is thus an important object of the present invention to provide a means for creating designs on a screen formed by the slats of a venetian blind.

These and other objects are accomplished by a louver system consisting a plurality of slats forming a screen, individual slats being multi-layered over at least a part of their length, said multi-layered slats being design coordinated with other multi-layered slats to form graphics in the face of the screen.

Other objects and advantages of the present invention will become apparent from a reading of the following specification taken in connection with the accompanying drawing wherein:

DETAILED DESCRIPTION OF THE DRAWING

Figure 1:
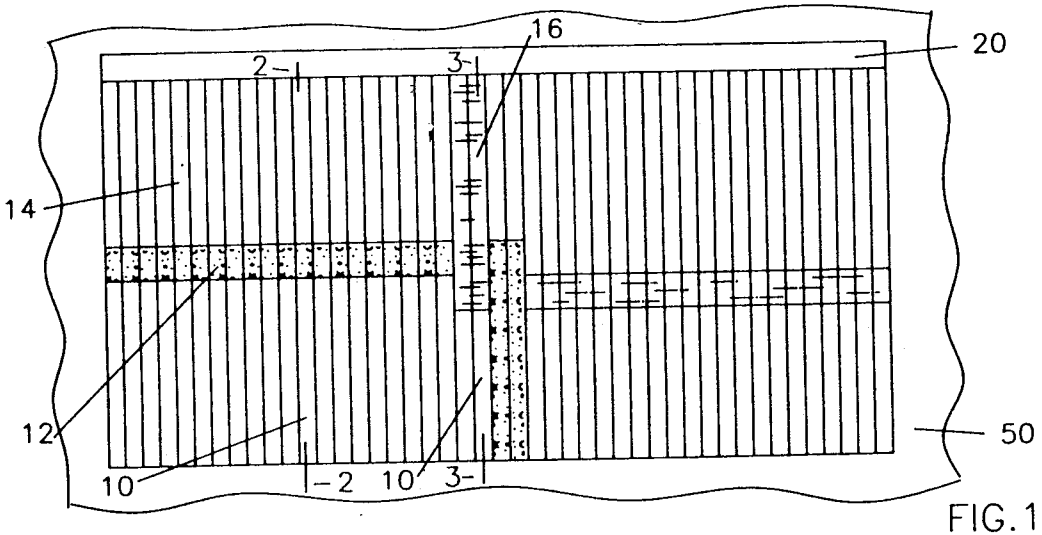
FIG. 1 is a plan view of a blind having a design formed in accordance with the present invention.

In FIG. 1 there is a shown a venetian blind designated generally by numeral 50 made up of a plurality of slats designated generally by numeral 10. In this instance the blind is a vertical blind but for all intents and purposes the blind can be horizontal.

The slats hang from a common support maintained within housing 20 and are collectively movable and pivotable on individual mountings (not shown) which depend from the common support. An opening 22 is provided in each slat to provide support for a hook (not shown) which depends from the common support.

Figure 4:
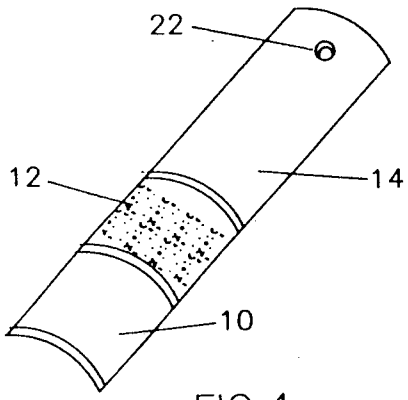
FIG. 4 is a perspective view of the top portion of the composite slat shown in FIG. 2.
Figure 3:
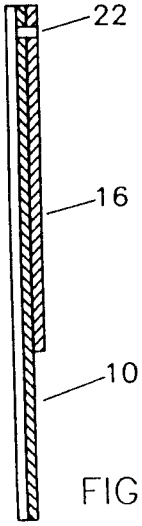
FIG. 3 is a sectional view taken on line 3—3 of FIG. 1 in the direction of the arrows.
Figure 2:
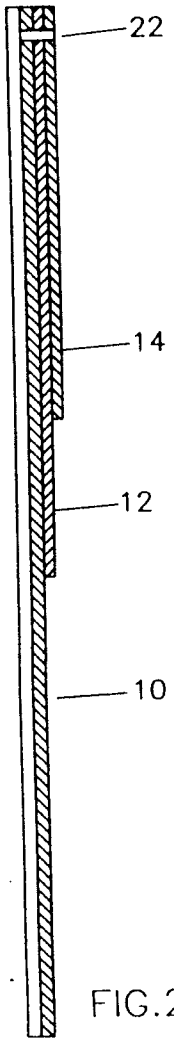
FIG. 2, is a sectional view taken on line 2—2 of FIG. 1, in the direction of the arrows.

As may be seen in the Figures the slats are multi-layered, each layer being of a relatively narrow gauge so as not to be cumbersome. It has been found preferable that the slats be curvi-linear as may be seen in FIG. 4.

Each layer making up the slat begins at a common point and terminates at a different point with respect to the other layers, each successive layer being shorter than the one preceding it. Designs are easily formed by placing shorter members such as 12 and 14 over longer member 10 as is shown in the figures.

The members may be of different colors and/or designs to achieve a particular desired graphic effect. The slats are sized and sprayed in advance with appropriate colors. An entire layer is sprayed with one particular color, for example, and the design is achieved by combining slats in any way desired. Thus painstaking painting, printing and measuring is completely avoided.

The layers are adhered to one another with an appropriate adhesive. The layers need not be adhered to one another but may hang from a common mounting in close proximity one to the other to achieve the desired effect. The curvi-linear shape of the slats promotes nesting. It would appear advantageous, however, to adhere the layers to one another.

It is not intended to limit the invention to the particular embodiment shown herein as the invention encompasses all embodiments falling with the spirit and scope of the appended claims.

I claim:

1. A louver system comprising a plurality of slats depending vertically from a mounting to form a screen, said slats being collectively displaceable and rotatable on their mountings, certain of the slats being multi-layered over at least a part of their length to form a laminate, each layer of said slats depending from the same mounting and being curvi-linear in cross section, each successive layer being shorter than the preceding layer, each multi-layered slat being coordinated with the one next to it to permit the formation of graphics in the face of the screen.

* * * * *